United States Patent [19]

Deaton et al.

[11] Patent Number: 4,832,200

[45] Date of Patent: May 23, 1989

[54] STACKING ARRANGEMENT FOR CONTAINERS

[75] Inventors: Thomas P. Deaton, Mason; Paul J. Ficker, Cincinnati, both of Ohio

[73] Assignee: Buckhorn Material Handling Group, Inc., Milford, Ohio

[21] Appl. No.: 106,409

[22] Filed: Oct. 6, 1987

[51] Int. Cl.[4] ..... B65D 21/02

[52] U.S. Cl. ..... 206/508; 206/509

[58] Field of Search ..... 206/508, 501, 503, 508, 206/509, 514

[56] References Cited

U.S. PATENT DOCUMENTS

| | | | |
|---|---|---|---|
| 2,761,582 | 9/1956 | Moore | 206/508 |
| 3,117,692 | 1/1964 | Carpenter | 206/508 |
| 3,360,162 | 12/1967 | Miles . | |
| 3,379,341 | 4/1968 | Miles | 206/508 |
| 3,392,875 | 7/1968 | Bockenstette . | |
| 3,419,184 | 12/1968 | Asenbauer | 206/508 |
| 3,675,815 | 7/1972 | Rehrig . | |
| 3,759,416 | 9/1973 | Constantine | 206/508 |
| 3,979,016 | 9/1976 | Frater | 206/508 |
| 4,093,071 | 6/1978 | Stahl et al. . | |
| 4,106,624 | 8/1978 | Thurman . | |
| 4,189,052 | 2/1980 | Carroll et al. . | |
| 4,379,508 | 4/1983 | Miller et al. . | |

*Primary Examiner*—George E. Lowrance

*Attorney, Agent, or Firm*—Fay, Sharpe, Beall, Fagan, Minnich & McKee

[57] ABSTRACT

A keyed, two part container for shipping or storing associated articles. The container includes a box portion having a generally planar base member, a pair of opposed sidewalls, and a pair of end walls defining an open area adapted to access a central cavity for receiving the associated articles. Lid receiving means is formed on the box portion, specifically, on the end walls. A lid portion is adapted for receipt over the open area of the box portion. The outer surface of the lid portion is provided with a preselected design that receives, in turn, a preselected pattern defined on an outer surface of the base member of another container. A first keyed means is defined by a continuous flange in the lid portion which matingly engages with the lid receiving means of a compatible box portion and interferes with the lid receiving means of a comparable box portion. Also, a second keyed means is defined by selected ridges extending from recessed areas of the box portion. The selected ridges matingly engage with recessed areas in the lid portion of a compatible container and interfere with a comparable lid portion.

6 Claims, 4 Drawing Sheets

STACKING ARRANGEMENT FOR CONTAINERS

BACKGROUND OF THE INVENTION

This invention pertains to the art of containers and, more particularly, to containers adapted for stacking and nesting relation with one another to facilitate loading and transporting of associated articles therein, as well as conserving space for interim storage or return transport.

The invention is particularly applicable to box-type containers that utilize a box portion and a separate, selectively removable lid portion and will be described with particular reference thereto. However, it will be appreciated that the invention has broader applications, and may be advantageously employed in other container environments and applications.

Typically, a commercial vendor receives various articles, commercial goods, and the like from different manufacturers and wholesale suppliers. These articles are supplied in so-called tote boxes or containers that facilitate carrying and transporting of the goods. Once these goods are unpacked at the commercial retailer, the containers are oftentimes stored until another delivery is made. In an effort to reduce the amount of space necessary to store these empty containers awaiting return to the appropriate supplier, the containers are adapted to nest within one another.

Yet another advantageous feature of these types of containers is the ability to stack filled containers one on top of another so as to facilitate transport. Various design configurations permit the lid portion of a container to receive the box portion of an associated container in stacked relation and limit lateral and longitudinal movement of one container relative to another.

As is so often the case, and in such a competitive commercial market, an initial supplier quickly realizes that other suppliers utilize like containers. In an effort to capitalize on the initial supplier's foothold in the marketplace, for example, the second supplier oftentimes designs his containers to not only next with, but also stack and receive, the first supplier's container. Confusion results from the interchangeability of the different containers. A first manufacturer only wants to be responsible for his own containers, not for any problems or defects that may result from a second manufacturer supplying compatible containers. In fact, if some containers are returned to the wrong supplier, the compatibility between the various containers permits continued use by a competitor of the first supplier's containers and at a substantial economic disadvantage to the first supplier.

Also, and for example with a restaurant, one container manufacturer may desire to manufacture comparable lines of containers in which the various container lines are incompatible with one another. A single container manufacturer can sell different container lines to different food suppliers who, in turn, may supply to the same restaurant. It has been considered desirable to key or code the containers of the different food suppliers so that their own containers do not become intermixed with other food suppliers. The container manufacturer can thereby provide some assurance to the different food suppliers that their containers will be returned to them.

For example, two container manufacturers L and M sell their containers to common food supplier N. The food supplier N packages different foods in different containers but has no manner of distinguishing between the goods once they are packed in their containers. Through use of keyed containers, for example supplied by container manufacturer M, food supplier N is able to differentiate the containers from those supplied by container manufacturer L.

As an additional benefit, food supplier N can distinguish between different keyed container lines supplied by manufacturer M. Thus, for example, one keyed line of containers can be used to supply chicken while another keyed line of containers receives baked goods. The container manufacturer M benefits since his containers can be easily separated from those of manufacturer L. The food supplier benefits since he will be more likely to be returned his container from a restaurant that also does business with a food supplier who uses containers from manufacturer L. Also, and as described above, food supplier N can differentiate between his own product lines through use of keyed containers.

The subject invention is deemed to meet these needs and others by overcoming the problems associated in the prior art in a simple, economical manner.

SUMMARY OF THE INVENTION

The present invention contemplates a new and improved container design.

In accordance with the subject invention, a container for storing or shipping associated articles comprises a box portion having a generally planar base member. The base member includes an outer surface having a first preselected pattern defined by a recess channel and an outwardly extending, keyed ridge associated with the channel. A pair of sidewalls and opposed end walls cooperate with the planar base member to define a cavity adapted to receive the associated articles therein. A lid portion includes a generally planar member having first and second opposed surfaces. The first surface has a second preselected pattern defined by segmented ridges and recessed channels. The lid portion channels operatively receive the keyed ridge of compatible box portions. Further, the lid portion includes means for locking with a lid receiving lip of a compatible box portion.

According to a more limited aspect of the invention, the planar member channels receive comparable box portions.

According to yet another aspect of the invention, the locking means interferes with strengthening ribs of a comparable box portion.

According to a still further aspect of the invention, the locking means includes a continuous flange having an inward dimension such that the flange remains spaced from the strengthening ribs of a compatible box portion in a closed position.

According to another aspect of the invention, the keyed ridge extends outwardly from the base member a dimension no greater than the outward dimension of the segmented ridges from said planar member.

A principal advantage of the invention is an improved container for stacking arrangement.

Yet another advantage of the invention resides in the keyed arrangement and the ability to matingly engage compatible containers and interfere with comparable containers.

Yet another advantage of the subject invention resides in the ability to form subsets of a keyed arrangement.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof, and wherein.

DETAILED DESCRIPTION OF THE PREFERRED EMBODIMENT

Figure 1:
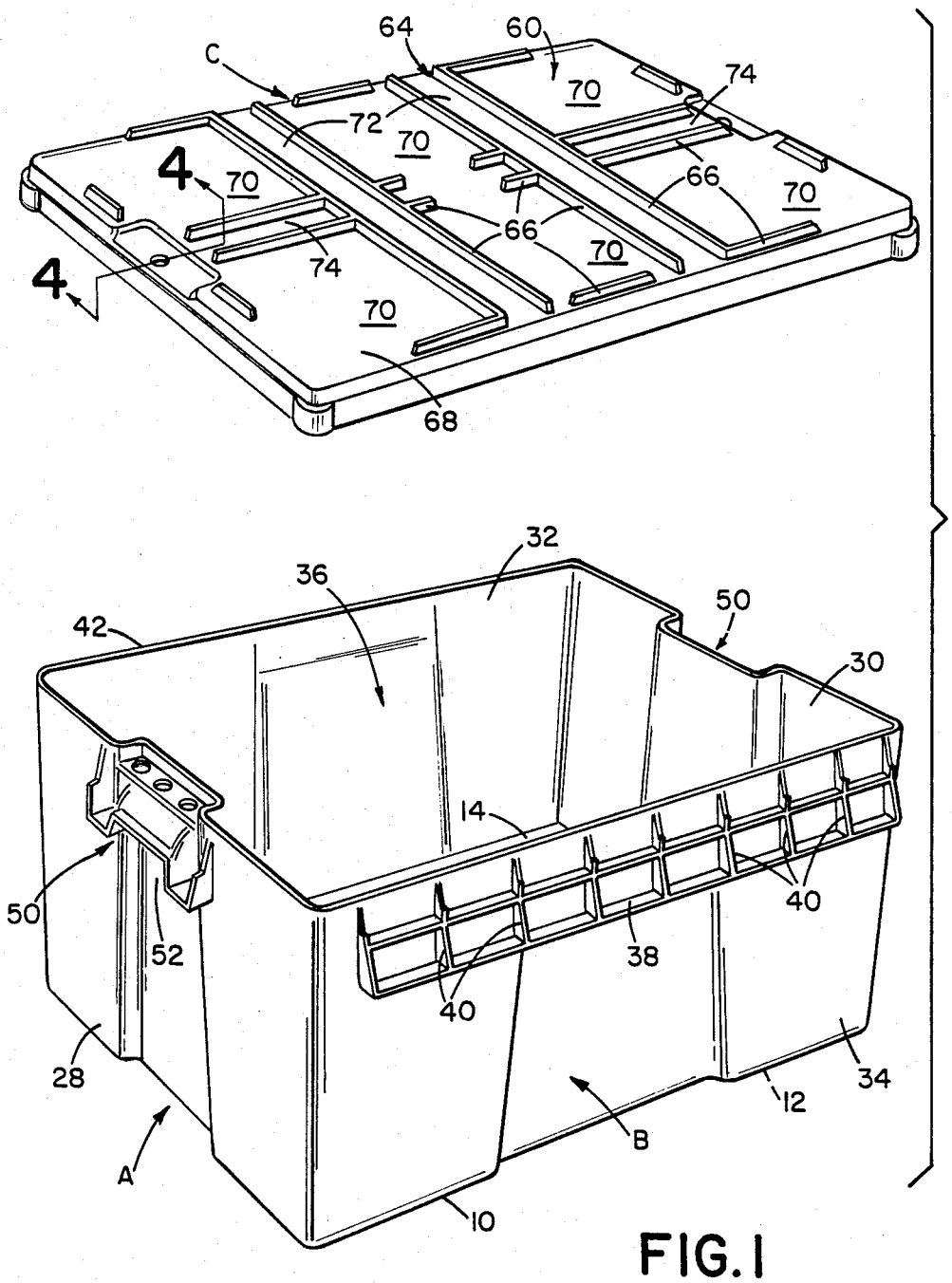
FIG. 1 is a perspective view of a container formed in accordance with the subject invention in which the lid portion is separated from the box portion.

Referring now to the drawings, wherein the showings are for purposes of illustrating the preferred embodiment of the invention only and not for purposes of limiting same, the FIGURES show a nestable and stackable container A having a box portion B that selectively cooperates with a lid portion C. The invention is particularly directed to an arrangement wherein a container may be stacked with or matingly receive a compatible container but will not stack or cooperate with selected comparable containers. For purposes of the following discussion, a compatible container is defined as a like or substantially like container that matingly engages, receives, or cooperates with a first container. On the other hand, a comparable container or comparable portion is one that has some common features with the first container but does not include the necessary similar features required to engage, receive, or cooperate in some manner with the first container.

The container A of the subject invention is adapted to receive commercial articles and the like therein. Once the lid portion C is placed in a closed position with the box portion B, compatible containers may be stacked one upon another to facilitate storage and shipment. Also, compatible containers may be nested one inside another to conserve space during interim storage and facilitate return of the container to its proper owner.

Figure 2:
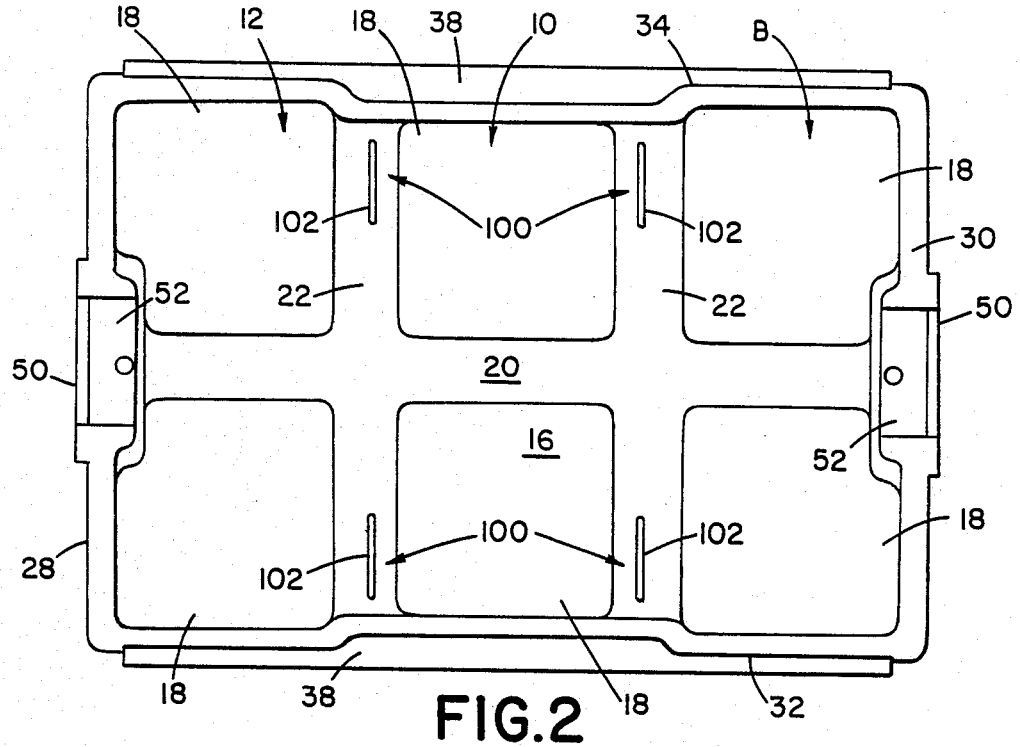
FIG. 2 is a plan view of the bottom or outer surface of the box portion formed according to the subject invention.

The box portion B includes a generally planar base member 10 which, as illustrated in FIGS. 1 and 2, has a generally rectangular peripheral configuration. The base member includes a first or outer surface 12 and a second or inner surface 14. The first surface includes a preselected pattern such as the compartmentalized design 16 illustrated in FIG. 2. More particularly, the compartmentalized design includes spaced projecting or raised regions 18 that are divided by recessed or depressed channels 20, 22. According to this preselected design, the recessed channel 20 extends generally longitudinally between opposed end walls 28, 30. The recessed channels 22 similarly extend laterally across the base member between sidewalls 32, 34. The projecting regions 18 extend outwardly from the recessed channels 20, 22 only a limited dimension to provide rigidity and assist in stacking arrangement of compatible containers in a manner to be described further hereinbelow.

Preferably, the end walls 28, 30 are integrally formed along a lower edge with the base member 10. Likewise, sidewalls 28, 30 are integrally formed with the base member along lower edges thereof. As is also apparent in FIG. 1, the end walls and sidewalls are integrally formed to one another along their contiguous edges. Thus, the box portion is a unitary structure that is typically formed in a mold process or like manner. Additionally, the sidewalls and end walls slope upwardly and outwardly from the base member to assist in nesting arrangement of compatible containers as will also become more apparent below.

The base member, end walls, and sidewalls define a central cavity 36 for receiving associated articles (not shown) therein. A nesting flange 38 is provided on each of the sidewalls 32, 34. Since the sidewalls and end walls extend outwardly from the base member in a generally tapered relation, the base member of one container is freely received within the cavity 36 of a compatible container. Strengthening ribs 40 are spaced along and extend outwardly from the sidewalls to the nesting flange 38 to provide further rigidity and support thereto. As will be apparent to those skilled in the art, the nesting flanges 38 are adapted for abutting engagement with an upper peripheral edge 42 defined on the end walls and sidewalls. This abutting engagement between a peripheral edge of one box portion and a nesting flange of another box portion limits the maximum extent of insertion of one into another in nesting relation.

Handle means 50 is disposed on each end wall 28, 30. Each handle means includes a recessed, finger receiving area 52 that easily accommodates gripping relation by a worker. Preferably, the handle means is disposed adjacent the peripheral edge 42 along the end walls. Further, the handle means remains easily accessible and uninhibited once the lid portion C is received in closing relation on the box portion.

Figure 3:
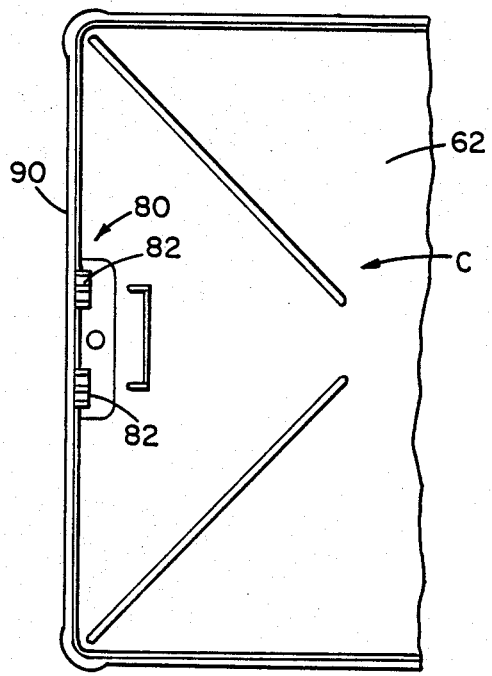
FIG. 3 is a plan view of the lower or inner surface of the lid portion of the subject invention.

The lid portion C includes a first or outer surface 60 (FIG. 1) and an opposed second or inner surface 62 (FIG. 3). The outer surface 60 includes a preselected pattern 64 that matingly receives the compartmentalized design 16 of a compatible box portion in stacking relation. More specifically, the preselected pattern is defined by outwardly extending segmented ribs 66 that divide generally planar member 68 into discrete receiving areas 70 that accommodate the spaced projecting regions 18 of the box portion. Further, the segmented ribs 66 extend in generally longitudinal and lateral relation across the planar member. A typical arrangement positions a pair of segmented ribs in generally parallel relation to one another to define recessed channels 72, 74 therebetween. The spacing of the segmented ribs is dimensioned to closely correspond to the width or dimensional spacing of the recessed channels 20, 22 of a compatible box portion. Thus, and as is further apparent in FIGS. 5A and 5B, a lid portion C is adapted to matingly receive compatible box portions. Moreover, the projecting regions 18 of a box portion are received in associated receiving areas 70 of a lid portion. The segmented ribs 66 extend outwardly from the planar member 68 to sufficiently engage the projecting regions of a box portion and limit lateral and longitudinal movement relative to the lid portion in stacked relation.

Figure 4:
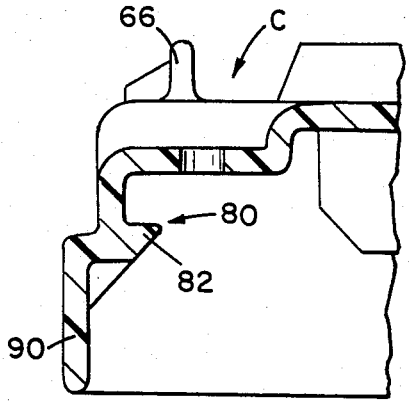
FIG. 4 is an enlarged, cross-sectional view of the lid portion taken generally along the lines 4—4 in FIG. 1.

Turning now to FIGS. 3 and 4, a first keyed means 80 is provided on the lid portion C. The first keyed means includes generally inwardly extending flanges or lips 82 intermediately disposed on an end region of the lid portion. Although one end of the lid portion is shown, it will be understood by one skilled in the art that at least one inwardly extending lip may be disposed at the other end of the lid portion if desired. The preferred construction of the lip is an angular conformation that facilitates closure and locking relation with a compatible box portion as described below.

Figure 7A:
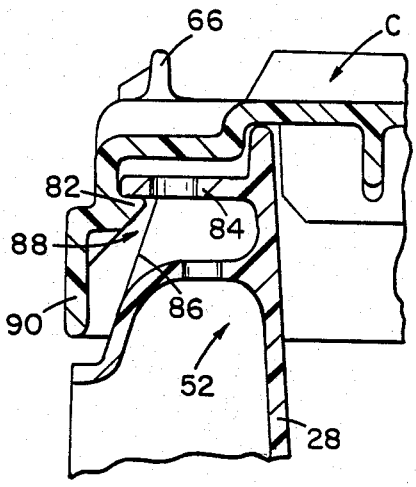
FIG. 7A is a vertical, cross-sectional view of the lid portion of the subject invention matingly cooperating with a compatible box portion.
Figure 7B:
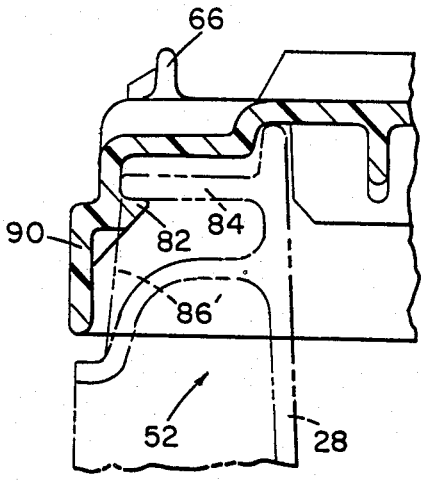
FIG. 7B is a vertical, cross-sectional view of the lid portion of the subject invention and its interfering engagement with the box portion of a comparable container shown in phantom.

With continuing reference to FIGS. 3 and 4, and with additional reference to FIGS. 7A and 7B, the snap-fit relation of a lid portion C with a box portion B is clearly illustrated. A compatible box portion includes a generally planar, cantilevered lid receiving tongue 84 that is buttressed by plural strengthening ribs or gussets 86. The tongue and strengthening ribs define an angular cutout region 88 adapted to closely receive the lip 82 (FIG. 7A). The inward extension of the lip 82 from a peripheral rim 90 of the lid portion C, as well as the angular conformation of the lip, is limited so as to prevent interfering contact with the strengthening ribs 86. In fact, the dimensional relationship between the lip 82, tongue 84, and strengthening ribs 86 is closely controlled so that the lid portion snaps over the tongue and is engaged underneath to limit free removal of the lid portion.

On the other hand, the strengthening rib 86' of the comparable box portion (FIG. 7B) is disposed in such a manner that it interferes with and prevents receipt of the lip 82 under the tongue 84. Oftentimes, comparable box portions utilize a strengthening rib as a single, arcuate extension that buttresses only the central portion of the tongue 84. Thus, provision of a generally continuous flange lip rather than the spaced lips 82 shown in FIG. 3 will interfere with this comparable strengthening rib arrangement. Inward flexing of the lip underneath the lid receiving tongue 84 is prevented and any locking relation with the comparable box portion is inhibited. Thus, the keyed means 80 of the lid portion rejects operative engagement with a comparable box portion.

A second keyed means 100 is provided on the box portion B. According to the preferred embodiment, the second keyed means includes at least one projecting ridge 102 extending outwardly from the base member 10 at an area disposed in the recessed channels. In accordance with the subject invention a plurality of elongated ridges are disposed at preselected areas in the recessed channels. As illustrated in FIG. 2, the elongated ridges are in generally parallel relation with the laterally extending recess channel 22 although other arrangements are contemplated.

Figure 5A:
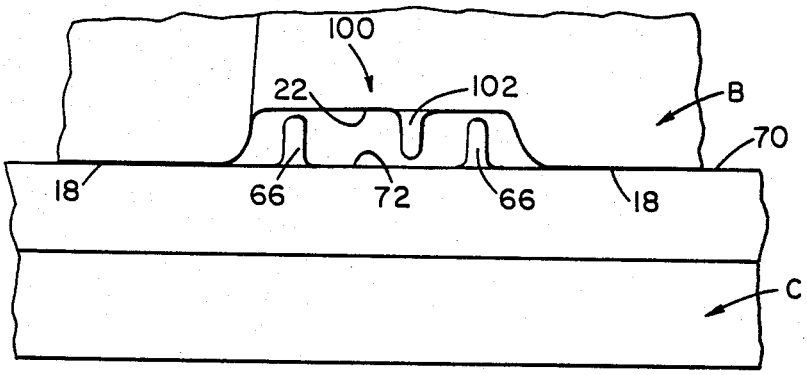
FIG. 5A is a vertical, cross-sectional view of the keyed box portion of the subject invention in mating relation with a compatible keyed lid portion of the subject invention.
Figure 5B:
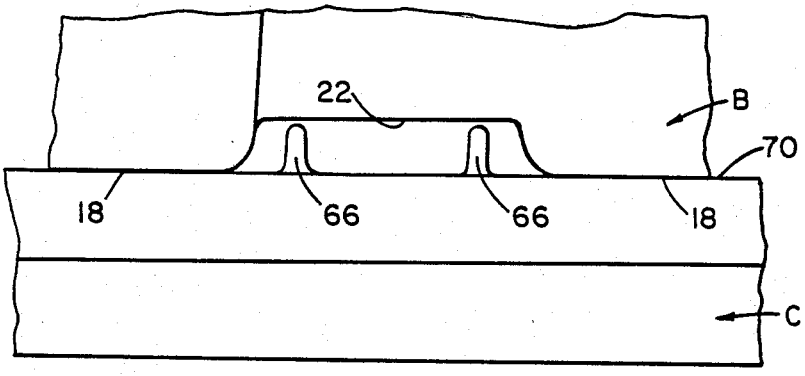
FIG. 5B is a vertical, cross-sectional view of a comparable box portion in mating relation with the keyed lid portion of the subject invention.
Figure 6:
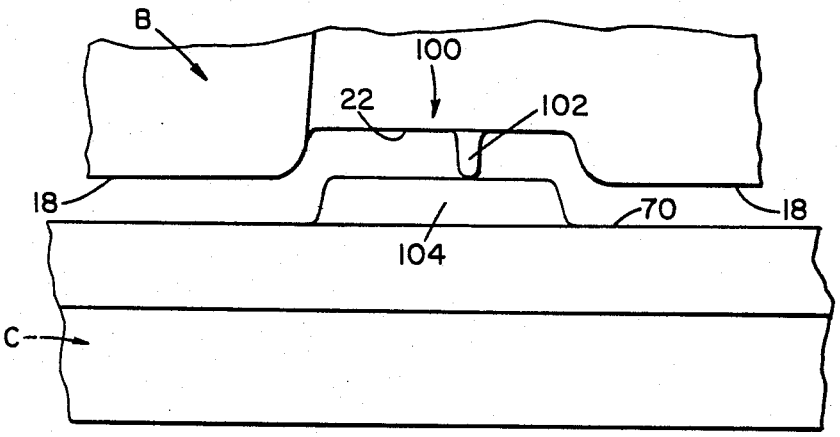
FIG. 6 is a vertical, cross-sectional view of the keyed box portion arrangement of the subject invention interfering with a comparable box portion.

With additional reference to FIGS. 5 and 6, it is apparent that each individual ridge extends outwardly from the base member a dimension no greater than the spaced projecting regions 18. Thus, and as shown, when a box portion B is received in stacked relation with a compatible lid portion C, the ridges 102 are freely received in the laterally extending recessed channels 74 (FIGS. 5A and 5B). As illustrated in FIG. 6, a keyed box portion B will not seat in stacked relation with a comparable lid portion C'. In this arrangement, the comparable lid portion does not utilize a pair of spaced, segmented ribs to define a channel but, instead, separates the receiving areas 70 by a continuous outwardly extending protrusion 104. As is clearly apparent, but for the second keyed means 100 utilized in the box portion B, the box portion and a comparable lid portion would otherwise seat in mating relation. Inclusion of the ridge 102 in the recessed channel 22 interferes with the continuous protrusion 104 of the comparable lid portion and thus prevents receipt of the projecting regions 18 into the receiving areas 70. As is also apparent, the keyed means 100 could be provided in either the longitudinal or the lateral recessed channels with the same result.

Figure 8A:
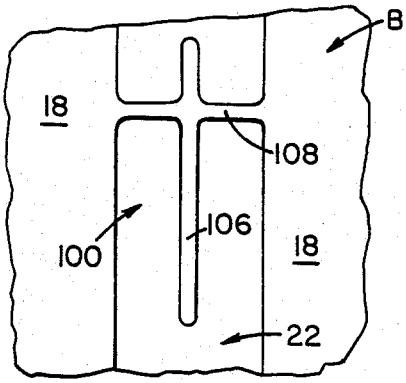
FIG. 8A is an enlarged plan view of a region of the box portion showing a first alternative keyed arrangement.
Figure 8B:
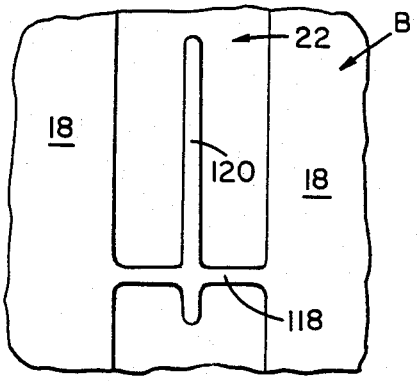
FIG. 8B is an enlarged plan view of a region of the box portion showing a second alternative keyed arrangement.
Figure 9A:
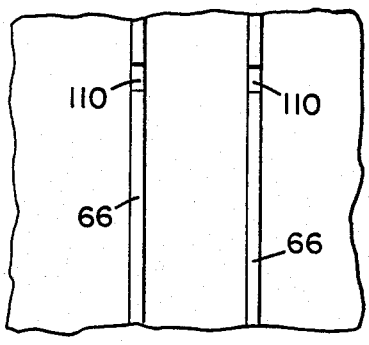
FIG. 9A is an enlarged plan view of a region of the lid portion showing a keyed arrangement compatible with the box portion of FIG. 8A.

Alternative keyed arrangements are illustrated in FIGS. 8 and 9. In FIG. 8A, a cross-shaped keyed means includes an elongated ridge 106 and a transverse ridge 108. The outermost ends of the transverse ridge 108 are designed to intersect with the projecting regions 18 of the box portion B. Thus, provision must be made in a compatible lid portion illustrated in FIG. 9A to receive the alternate keyed arrangement. More specifically, the parallel segmented ribs 66 include gaps or breaks 110 adapted to receive the transverse ridge 108 of the alternate keyed means.

Figure 9B:
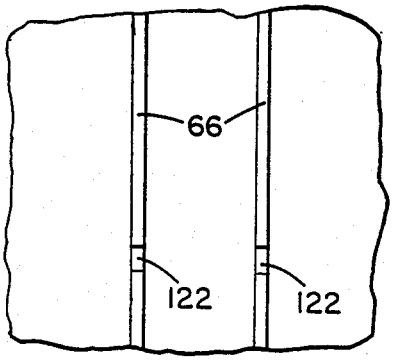
FIG. 9B is an enlarged plan view of a region of the lid portion showing a keyed arrangement compatible with the box portion of FIG. 8B.

Likewise, FIGS. 8B and 9B alter the position of the transverse ridge, as represented by numeral 118, relative to the elongated ridge 120. The outermost ends of this transverse ridge are also adapted to intersect with the projecting regions 18 of a box portion. A mating, compatible lid portion as shown in FIG. 9B requires use of breaks 122 in the segmented ribs in order to accommodate the transverse ridges 118.

Of course, still other patterns may be utilized with equal success as one measure of providing a keyed means between the box and lid portions of a container. In other words, the ridge 102 is designed to prevent mating engagement with a comparable lid portion. The ridge 102 abuttingly engages the protrusion 104 and prevents receipt of the projecting regions 18 into the receiving areas 70 as described above. Likewise, the alternate arrangements shown in FIGS. 8 and 9 interfere with a lid portion C as illustrated in FIG. 6. The keyed projecting ridges also engage the protrusion 104 of a comparable lid portion to prevent receipt in channel 22.

Additionally, a subset arrangement is provided by the embodiments of FIGS. 8 and 9. The projecting ridges 66 with, alternately, the breaks 110 or 122 defined therein will accommodate the keyed box portion shown in FIG. 2 since the ridges 102 are received in the recess channels 74. Nevertheless, the transverse ridges 108, 118 in the FIG. 8A and 8B embodiments, respectively, are not compatible with the lid portion shown in FIG. 5A or 5B due to the interfering engagement with ridges 66. Thus, a manufacturer can produce a generic keyed arrangement, e.g. the keyed ridge 102 of FIG. 2, and particular subsets, e.g. the keyed ridges 106, 108 and 118, 120 of FIGS. 8A and 8B.

A first container manufacturer may sell his containers to different vendors. Some stores, restaurants, and the like may themselves receive products from both of these vendors who have bought their containers from the same first manufacturer. Thus, these vendors are able through use of the keyed means to maintain control over those box and lid portions which they originally purchased from the first container manufacturer. Additionally, their containers will not mate with comparable containers that may be in circulation from a second container manufacturer. Still further, a single vendor can differentiate between his own separate container lines through use of keyed means creating various subsets.

The invention has been described with reference to the preferred embodiment. Obviously modifications and alterations will occur to others upon a reading and understanding of this specification. It is intended to include all such modifications and alterations insofar as they come within the scope of the appended claims or the equivalents thereof.

Having thus described the invention, it is now claimed:

1. A series of containers for storing and shipping associated articles comprising:

a plurality of containers, each container having a box portion including:

(a) a base member having first and second opposed surfaces;

(b) first and second sidewalls extending outwardly from said base member;

(c) first and second end walls extending outwardly from said base member and interconnecting said first sidewall with said second sidewall;

(d) a cavity defined by said base member, sidewalls, and end walls to receive associated articles therein; and a lid portion including:

(e) a generally planar member having first and second opposed surfaces;

(f) a rim portion extending outwardly from said planar member along a peripheral region thereof;

each of said containers having means for keying said plurality of containers, said keying means including a first preselected pattern on said base member first surface and a second preselected pattern on said planar member first surface, said keying means defining a set of compatible containers; and, said keying means including means for forming a first subset compatible with said set and means for forming a second subset compatible with said set and incompatible with said first subset.

2. The container series as defined in claim 1 wherein said base member preselected pattern includes a plurality of distinct projecting regions, said projecting regions being spaced from one another by a plurality of recessed regions.

3. The container series as defined in claim 2 wherein at least one of said recessed regions includes a projecting ridge, said ridge matingly received in an associated channel in a compatible lid portion and interfering with a comparable lid portion.

4. The container series as defined in claim 1 wherein said lid portion matingly receives both compatible and comparable box portions in stacking relation.

5. The container series as defined in claim 1 further comprising means operatively associated with said lid portion for locking with a compatible box portion and for interfering with a comparable box portion.

6. The container series as defined in claim 5 wherein said locking and interfering means includes a generally continuous lip for matingly engaging a compatible box portion and rejecting a comparable box portion.

* * * * *